US008279050B2

(12) United States Patent
Coombs

(10) Patent No.: US 8,279,050 B2
(45) Date of Patent: Oct. 2, 2012

(54) MULTIPLE USER CONTROLLED OBJECT

(76) Inventor: David Coombs, Tucson, AZ (US)

( * ) Notice: Subject to any disclaimer, the term of this patent is extended or adjusted under 35 U.S.C. 154(b) by 248 days.

(21) Appl. No.: 12/794,722

(22) Filed: Jun. 5, 2010

(65) Prior Publication Data

US 2010/0315262 A1 Dec. 16, 2010

Related U.S. Application Data

(60) Provisional application No. 61/187,075, filed on Jun. 15, 2009.

(51) Int. Cl.
*G08C 19/12* (2006.01)

(52) U.S. Cl. ..... 340/13.24; 446/454; 446/456; 463/36; 463/37

(58) Field of Classification Search ..... 340/2.2, 340/2.6, 5.73, 12.22, 12.24, 12.27, 12.29, 340/12.3, 13.24, 13.25, 13.27, 13.28; 463/36, 37, 39; 446/454, 456; 455/103, 418–420; 341/173, 176
See application file for complete search history.

(56) References Cited

U.S. PATENT DOCUMENTS 6,247,994 B1 * 6/2001 DeAngelis et al. ..... 446/454
2003/0148703 A1 8/2003 Scott et al.
2005/0287920 A1 * 12/2005 Lucas et al. ..... 446/454
* cited by examiner

*Primary Examiner* — Brian Zimmerman
*Assistant Examiner* — Laura Nguyen

(57) ABSTRACT

In accordance with the present invention, electronic mixing is provided between multiple instruction channels from multiple users of a single controlled object such that each user can have partial control over the object at the same time. The percentage of partial control is adjusted between users according to any combination of the number of users, preset or user set percentages, randomness, or computer generation.

6 Claims, 4 Drawing Sheets

MULTIPLE USER CONTROLLED OBJECT

RELATED APPLICATIONS

The present application is a continuation application of U.S. provisional patent application Ser. No. 61/187,075, filed Jun. 15, 2009, for VARIABLE GAIN APPLIED TO MULTIPLE RECEIVERS AND/OR TRANSMITTERS, by David M. Coombs, included by reference herein and for which benefit of the priority date is hereby claimed.

The present application is related to United States patent number 20030148703, issued Aug. 7, 2003, for SYSTEMS AND METHODS FOR RADIO CONTROL AND OPERATION OF A MINIATURE TOY VEHICLE INCLUDING INTERCHANGEABLE BODIES, included by reference herein.

FIELD OF THE INVENTION

The present invention relates to controlled objects, more particularly, to multiple users controlling a single object.

BACKGROUND OF THE INVENTION

The remote control hobby and toy industry has been rapidly growing through the years with smaller, better, and cheaper control systems. The small size and light weight of modern RC receivers make them nearly inconsequential to carry on toys including flying vehicles. They no longer require long antenna wires and are immune to the multiple transmitter interference that plagued older systems. Infrared systems are also in widespread use as low cost, light weight, and small size solutions for manipulating remote controlled toys. These advancements now make it practicable to use multiple receivers and multiple transmitters to control a single object, paving the way for a Multiple User Controlled Object.

A new world of gaming opportunities is created when two or more players are concurrently commanding the actions of a single physical object. For simplicity, the term "instruction" will be used to define a user's command to manipulate the actions of a controlled object, and the term "control" will be used to define what the object actually responds to. The percentage of control that is used to manipulate any single function on a controlled object, from any single player, can be adjusted to any percentage from 0% to 100% of the user's instruction. In the case of a toy car, for example, two players might have 50% control of the car's steering. If one player instructs the car to turn all the way left while the second player keeps the steering in a neutral position, the car will only turn left with half of its capable turning radius. The second player can instruct the car to turn right to counteract the first player's instruction and keep the car going straight, or assist the first player's instruction by also turning left causing a full-radius left turn. This same concept may apply to other channels such as the car's speed and direction.

By using a separate channel, called an exchange channel, it is also practicable for a player to be able to give up a certain percentage of instruction on one channel in order to enhance the percentage of instruction on a different channel. For example, if player 1 keeps the exchange channel at neutral while player 2 moves the exchange channel towards enhanced steering, then player 2 would have more influence over steering and less influence over speed while player 1 would have more influence over speed and less influence over steering.

When multiple users have only a certain percentage of instruction, the movement of the object is dictated by each player's particular skill and gaming goal, adding a new level of strategic challenge to the game. In the case of the toy car, the goal for players might be to get the car to enter their own individual space by crossing a particular goal line. The object's performance, type and number of control functions, skill level of all players, number of players, level of randomness, and prior knowledge of other players' strategies all play a part in the outcome of the game. Teams can be assembled when enough players participate where team members must work in concert with one another to achieve a common goal.

In addition to gaming, the multiple user control technology can be applied to training and safety of remotely or locally controlled objects where there is a single object that is monitored by a master user who is skillful in controlling the object, and the master can grant or remove any desired percentage of control to other inexperienced participants. The master user can take back control at any time to avert damage to the object or to prevent damage to nearby property or persons, such as to prevent the object from approaching a crowd of people and causing harm. Having a master user or moderator allows student users to safely learn how to command an object when such command is initially difficult, such as when learning to fly a high performance remotely controlled helicopter. It also allows a moderator to maintain a safe and fun environment when remotely controlled objects are operated in large groups, and with crowds of small children where the children are allowed to operate the object under the supervision of the moderator.

All of these gaming, training, and safety concepts are possible using inexpensive microcomputer technology to collect instruction input from two or more users, then scale and mix individual instruction channels to manipulate the action of a single controlled object.

Prior art solutions for physical object gaming provide a one-to-one correlation between a single user and a single controlled object using 100% control over the controlled object.

Prior art for use as a training aid uses a cord comprised of a physical cable that electrically connects two transmitters where one transmitter is the master, the second transmitter is the slave, and where the master transmitter provides a switch to transfer control between master and slave. Such systems are limited to switching 100% control between master and slave transmitters such that only one transmitter has 100% control over the functions of the controlled object at any one time.

Another similar means of switching between master and slave transmitters has been used where two transmitter and receiver pairs are utilized, and where both receivers reside within the controlled object. Such solutions are also limited to 100% switching by using a switch instruction channel on the master transmitter to switch full control of the object to use either the master or the slave receiver.

Gaming that involves commanding of physical objects such as toy car racing can aid in teaching hand and eye coordination. Prior art provides this, but strategic skills are not used as much because the objects themselves lack elements of surprise that can arise at any moment from another user with alternate goals for the same object. When objects are completely tied to a single user's instruction, physical coordination and reaction times remain as the dominant skills. Strategies and thought processes are different when multiple users are allowed to manipulate a single object because the object is no longer responding solely to a single user's physical reactions. This type of command involves real time consideration of an opponent's strategy and requires forethought regarding opponent's possible actions. By having joint control over a single object, attacking an opponent's object to gain an advantage is no longer an effective strategy because the perpetrator is compromised as well by doing so. Having the ability for many users to control a single object can aid in developing new skill sets, provide a new level of fun for the users, and provide a new level of entertainment for spectators that prior art lacks.

Using 100% control switching for training a student to operate an object that is difficult to control lends itself to a common shortcoming. Most students use excessive control when learning to operate complex remotely controlled objects, and the excessive control often impedes learning by repeatedly forcing the object into an awkward or even unstable state. Reducing the amount of control a student has over an object can often aid in teaching by avoiding unstable states in the first place. This allows the student to concentrate more on controlling the object and less on recovering from mistakes. Having a teacher dynamically vary the percentage of control that the student has over the object is not possible using prior art solutions.

SUMMARY OF THE INVENTION

In accordance with the present invention, mixing is provided between multiple users of a single controlled object such that each user can have concurrent partial control over the object in real time. The percentage of control over each controllable aspect of an object is adjusted between users according to any combination of the number of users, pre-set or user-set percentages, randomness, or computer input. Users can counteract or enhance their opponents' actions to manipulate the controlled object in accordance with gaming goals. Users may dynamically give up a percentage of control on one instruction channel in exchange for enhanced control on another instruction channel.

It is an objective of the invention to enable joint control of a single physical object by two or more users at the same time using variable percentage control over each controllable aspect of the object, mixing the common instruction channels, and using the resulting mixed control to manipulate the actions of the controlled object.

It is also an objective of the invention to provide new forms of advanced training where a master user and student user are controlling a single object by allowing the master to grant only limited control to the student, and increasing the level of control to the student as the student's skill level improves.

It is further an objective of the invention to provide safety precautions when operating a remotely controlled object near crowds of people by allowing the object to be controlled by several inexperienced users with a single skilled user being able to take over control of the object at any time.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
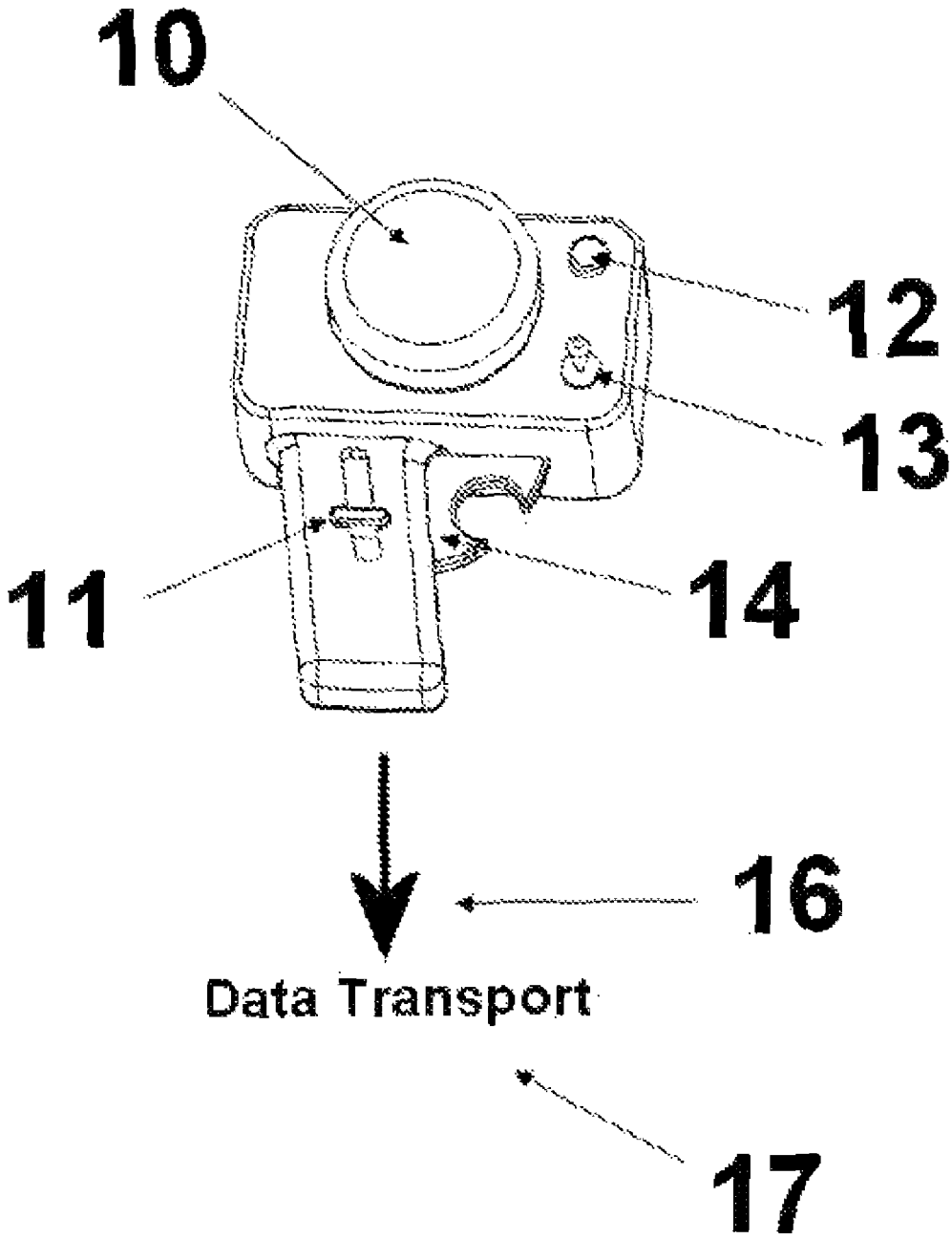
FIG. 1 is an illustration of a typical instruction module for a remotely controlled toy car with binary instructions for headlights and horn, and analog instructions for steering, forward and reverse speed, and channel exchange control.
Figure 2:
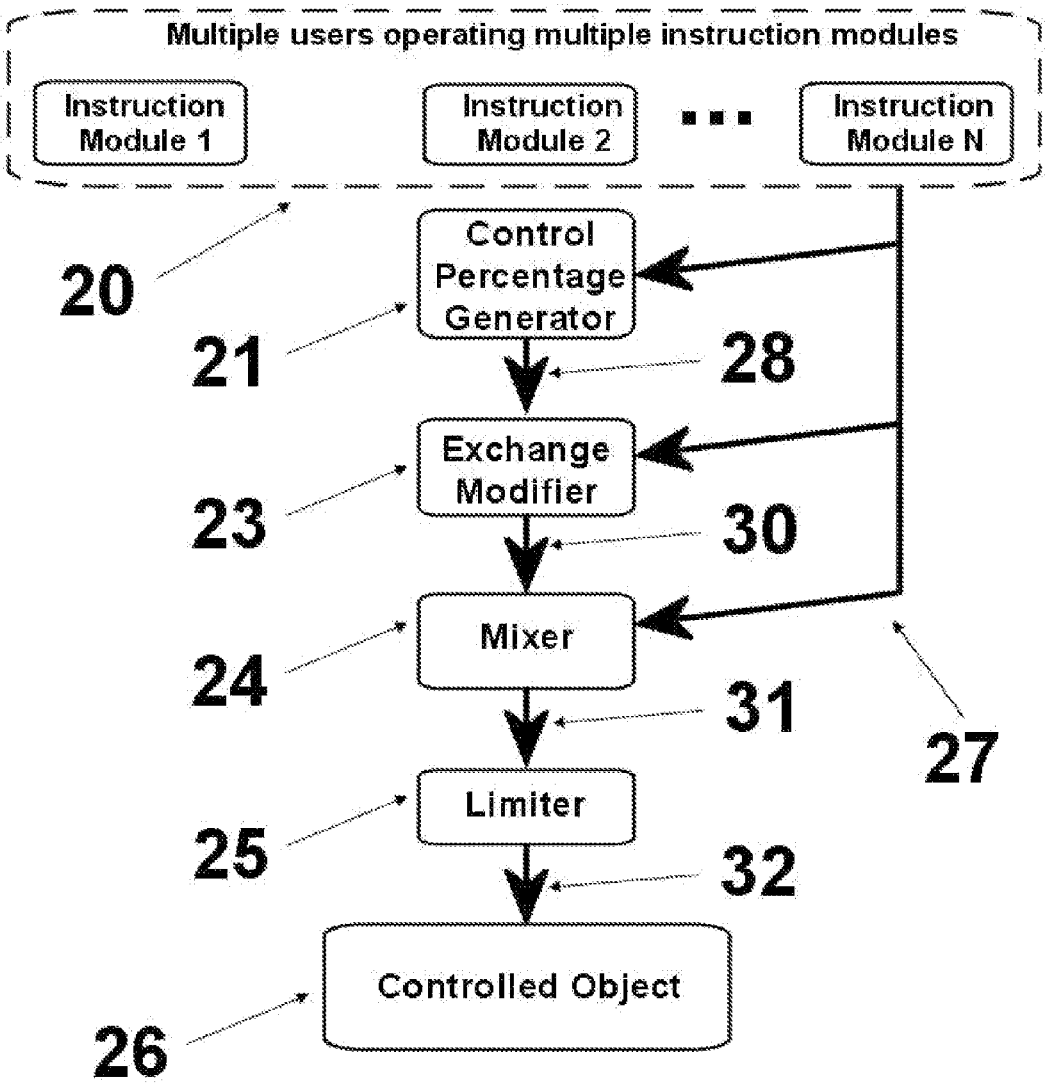
FIG. 2 is a functional flow diagram of multiple instruction modules used to manipulate the actions of a single controlled object.

The instruction module shown in FIG. 1 can be any electronic or electromechanical device that senses instruction input from a user, or group of users as shown in FIG. 2, and transports the sensed information to a centralized location where all common instruction inputs from all concurrent users can be combined and used to manipulate a single controlled object 26. Each instruction module may have many different sensors for instructing a variety of different channels to provide user input to any type of functionality that the controlled object 26 supports. The instruction module can support analog functions such as steering instruction 10, or speed and direction instruction 14, or it can support binary functions such as switch instruction 13 for headlights, or a momentary pushbutton instruction 12 for activating a horn. Each instruction module should be capable of generating sensor data that can operate the various channels of the controlled object 26 with 100% full-scale control, where a channel is defined as any single controllable aspect of the controlled object 26. An instruction channel group 16 is a group of channel instructions generated by an instruction module and modified by the user, which can be used to manipulate the controlled object 26. The instruction channel group 16 from each instruction module is used to create a combined instruction channel group 27 where it can be pooled with the instruction channel groups of one or more other instruction modules. The method for data transport 17 used to collect each instruction channel group 16 from the instruction module to the combined instruction channel group 27 can be performed using electronic means such as radio transmitters and receivers, optical transmitters and receivers, networked or sequenced radio or optical transmitters and receivers, or electric cable.

The control percentage generator 21 is a central process that computes the percentage of influence that each channel of each instruction channel group 16 will have on the controlled object 26. The control percentage can be calculated using any combination of the number of instruction modules currently in use, a user set percentage, randomness, or computer input. The output from the control percentage generator 21 may or may not be normalized such that the sum of all control percentage values from all common instruction channels within the combined control channel group 27 equals 100%, where a common control channel is defined as any individual channel from one instruction module that provides common functionality as other instruction modules currently in use, such as a steering instruction 10 channel.

The control percentage generator 21 produces a separate percentage of control for every channel of every instruction channel group 16 within the combined instruction channel group 27, with the exceptions of exchange and master override channel functions.

Figure 3:
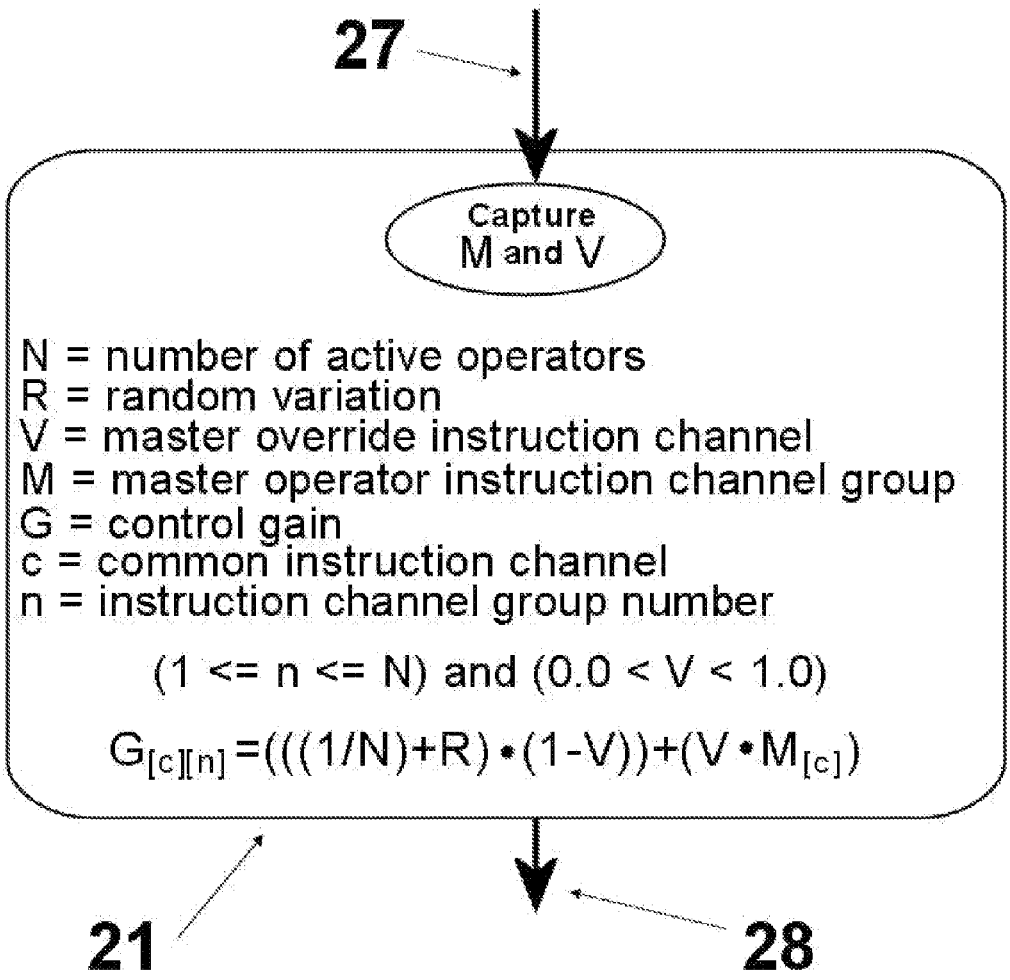
FIG. 3 is a control percentage generator used to adjust the amount of control from each channel of each instruction module.

An example of how the control percentage generator 21 might be implemented is shown in FIG. 3. In this example, a master user can take control of the object by setting the master override instruction to 1, or grant control to the rest of the combined users by setting the master override instruction to 0. Control between the master user and other users can vary as an analog setting when the master override is set to any value between 0 and 1. When the master override instruction is set to 0, other users share control over the controlled object 26 as a function of how many users are currently active. If there were two other users, then each could have 50% control; four other users could each have 25% control, and so on. A small amount of randomness R is included in this example that can dynamically grant or deny a small percentage of differential control to each user. The randomness R is optional. A two-dimensional control percentage array 28 is generated from the example equation shown in FIG. 3 such that an individual control percentage is generated for every channel, c, from every user, n, including the master user control channel group 16, M. More simplistic forms of control percentage might use a common percentage for each control channel. If randomness and a master user were not used in the above example, then every control percentage would reduce to a constant value equal to 1/N.

Figure 4:
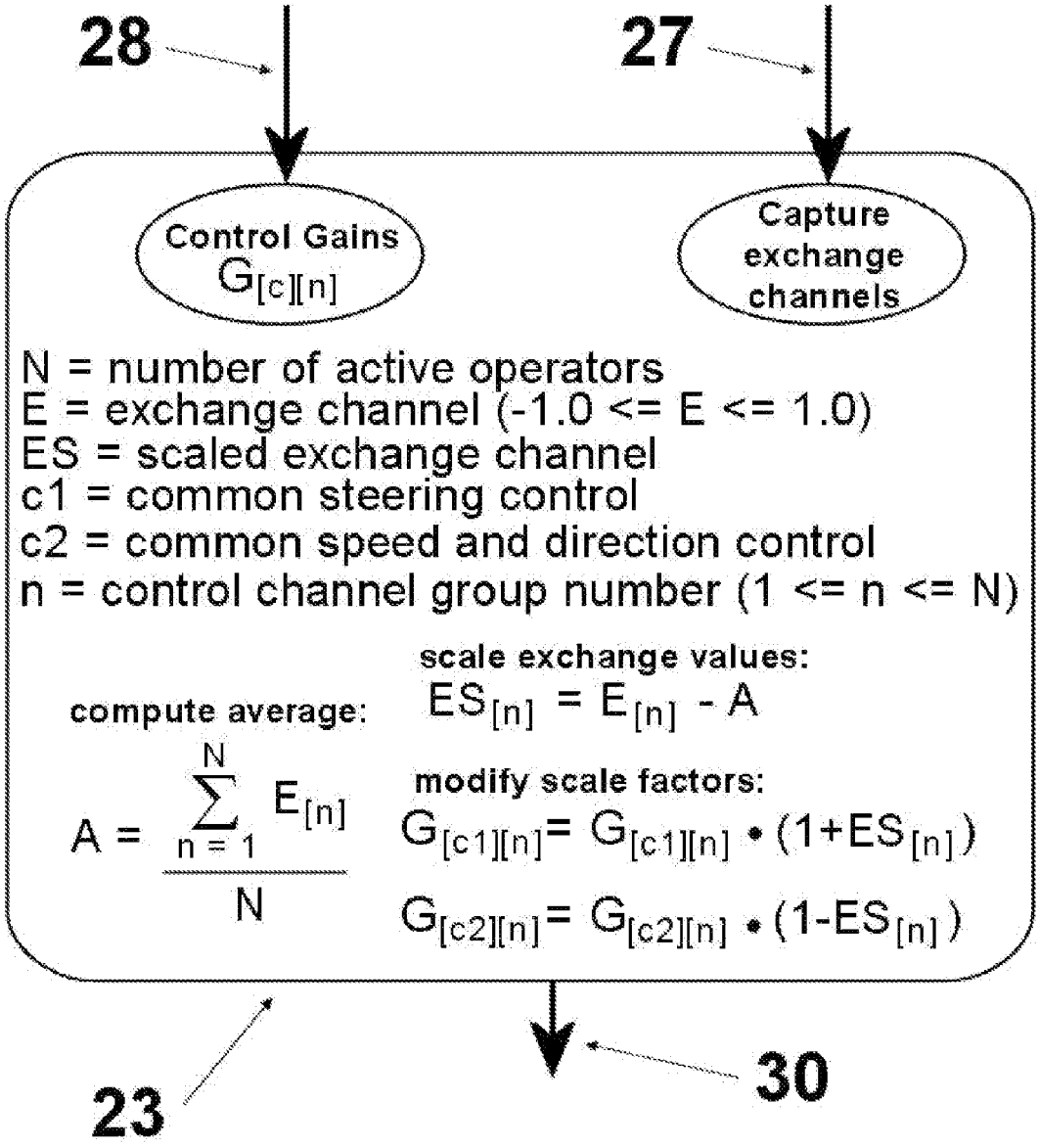
FIG. 4 is an example of exchange modifier equations that allow a user to execute balanced transfer of control from one instruction channel to another.

Exchange channel instruction 11 commands are optional. If used, they are collected as part of the combined instruction channel group 27, and are handled separately from other instruction channels. FIG. 4 illustrates an example of how the exchange modifier 23 would work, where each user varies the exchange channel instruction 11 to modify control percentage between steering instruction 10 and speed and direction instruction 14 in a balanced manner. The exchange channel information from each instruction channel group 16 is obtained from the combined control instruction group 27. The exchange channel information is averaged from all instruction channel group 16 inputs then scaled for each individual instruction channel group 16 to provide an equal and opposite percentage modification between steering instruction 10 and speed and direction instruction 14. The averaging and scaling is done to allow users to counteract their opponents' exchange channel instruction 11 and to avoid saturating control functions that can make the controlled object 26 ultra sensitive when most users have their exchange channel instruction 11 settings set to similarly high levels. The end result is an exchange modified control percentage array 30 that is modified with individual balanced percentage settings in accordance with all other exchange channel instruction 11 commands that may or may not counteract each other.

Every channel within an instruction channel group 16 is associated with a corresponding exchange modified control percentage that is used as a product term to scale the individual channel instructions from each user. As this scaling operation is performed, common channels from each instruction channel group 16 that modify the actions of the controlled object 26 in the same manner are summed together to create a single command path to the controlled object 26. The channel mixer 24 is used to perform this task. The end result is a single group of channel commands 31 that represent the combined input from the entire group of users 20 with all of the control and exchange channel scaling implemented as described above.

The control and exchange scaling can sometimes yield commands that are slightly outside the range of the controlled object's full-scale capabilities. Reducing normalized exchange channel limits, reducing overall percentage control to compensate for randomness, and other mathematical solutions can minimize such over-control, but it is sometimes advantageous to allow the enhanced control capability and clip excessive control through the use of a limiter 25. The limiter 25 allows the single group of channel commands 31 to exceed the limits imposed by the controlled object 26 by truncating any excessive command values to the maximum value allowed by the controlled object 26.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A multiple user controlled single object comprising:

two or more instruction inputs to a single object, with each instruction input generating a partial instruction for the purpose if manipulating a specific object function;

a means for combining said partial instructions into a final instruction where each partial instruction has partial control over said specific object function to a degree greater than zero percent and less than one hundred percent; and a means for manipulating the controlled object's function in accordance with the final instruction.

2. The multiple user controlled single object in accordance with claim 1, wherein each instruction input has a plurality of discrete instruction channels, with each discrete instruction channel generating a single partial instruction for the purpose of manipulating a corresponding specific object function; with the means for combining said partial instructions into a final instruction where each partial instruction has partial control over said corresponding specific object function to a degree greater than zero percent and less than one hundred percent; and where the means for operating the specific object function operates each discrete specific object function in accordance with the modified instruction generated for the corresponding instruction channel.

3. A multiple user controlled single object in accordance with claim 2, wherein said means for combining instructions comprises a control percentage generator having characteristics selected from the following group:

a means to define instruction percentage based upon number of active users;

a means to randomly modify one or more instructions;

a means to randomly modify one or more instruction channel percentages;

a means to define instruction percentage based upon fixed percentage; and a means to define instruction percentage based upon user input.

4. The multiple user controlled single object as recited in claim 3, further comprising: an exchange channel instruction, for limiting instruction percentage from one instruction channel in exchange for enhancing instruction percentage to a different instruction channel.

5. The multiple user controlled single object as recited in claim 3, wherein one or more users is a computer.

6. The multiple user controlled single object as recited in claim 4, wherein one or more users is a computer.

* * * * *